United States Patent [19]

Tazaki

[11] 4,301,631

[45] Nov. 24, 1981

[54] WATER COOLING JACKET FOR PROTECTION FROM FIRE

[76] Inventor: Michiji Tazaki, 3-3-46, Haraichi, Annaka City, Gunma Prefecture, Japan

[21] Appl. No.: 103,909

[22] Filed: Dec. 17, 1979

[51] Int. Cl.[3] ..... E05G 1/02; E04B 1/94

[52] U.S. Cl. ..... 52/168; 109/29

[58] Field of Search ..... 52/168, 404, 93; 109/29, 23, 24, 33, 15; 137/340; 220/13

[56] References Cited

U.S. PATENT DOCUMENTS

| | | | |
|---|---|---|---|
| 1,567,893 | 12/1925 | Baratta | 52/168 |
| 3,616,583 | 11/1971 | Weineck et al. | 52/168 |
| 3,709,169 | 1/1973 | Gauger et al. | 109/29 |
| 3,779,179 | 12/1973 | Marois | 109/29 X |
| 4,028,854 | 6/1977 | Diggs | 52/168 X |
| 4,075,798 | 2/1978 | Tazaki | 52/168 |

*Primary Examiner*—J. Karl Bell

*Attorney, Agent, or Firm*—Fleit & Jacobson

[57] ABSTRACT

This invention relates to a water cooling jacket for protection from fire which aims at the protection of a human body from fire. More particularly, it relates to a water cooling jacket for protection from fire characterized by being composed of: mounting a water tank on a ceiling of inner and outer side cases installed with a given interval; forming a water pool case capable of gathering waters outside the outer case; setting an outer wall-plate covered on the inside thereof with fiber plates, such as glass wools or the like, with given intervals outside the inner and outer cases; and making waters flowing from said water tank and said water pool case fall down along said outer wall-plate continuously.

6 Claims, 3 Drawing Figures

WATER COOLING JACKET FOR PROTECTION FROM FIRE

BACKGROUND OF THE INVENTION

This invention relates to an improved water cooling jacket of the type described in U.S. Pat. No. 4,075,798, which was previously developed by this inventor. The invention is particularly concerned with a jacket extremely resistant to fire by forming a water pool case outside double cases composed of inner and outer cases and an outer well-plate covered on the inner side thereof with fiber plates and mounting a large water tank on a ceiling of the cases.

DETAILED DESCRIPTION OF THE DRAWING

Figure 1:
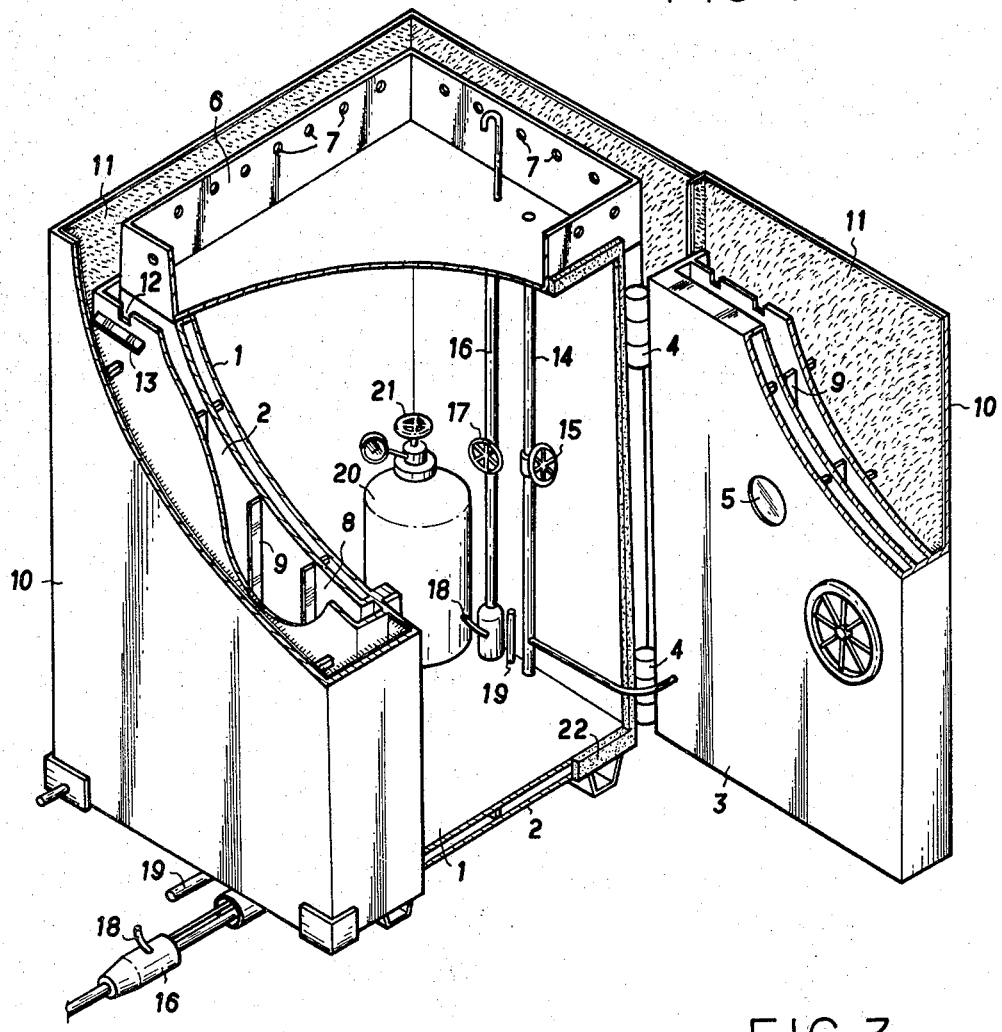
FIG. 1 is a perspective view of the jacket with its door open, according to this invention.
Figure 2:
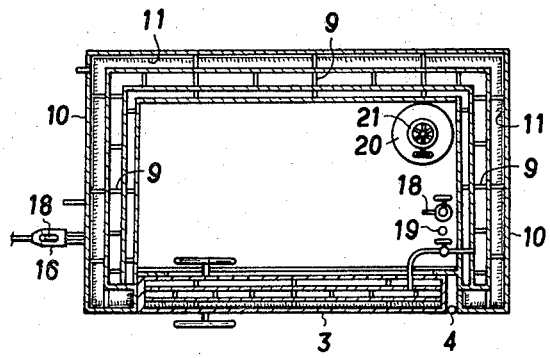
FIG. 2 is a transverse cross sectional view thereof.
Figure 3:
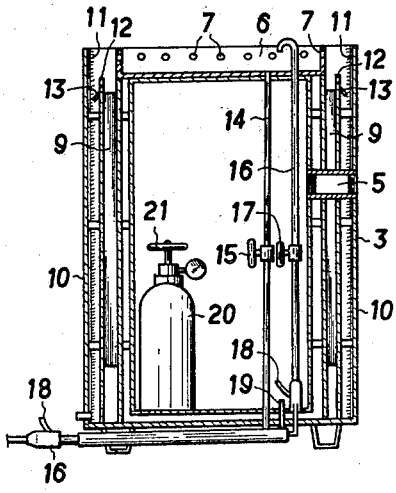
FIG. 3 is a vertical cross sectional view thereof.

With reference to the description of the example according to this invention with the accompanying drawings, FIG. 1 to FIG. 3, the numeral 1 is an inner case having an open front, which is incorporated in the outer case 2 having an open front, with given intervals between the cases. The numeral 3 is a door secured to the open surface positioned at the front of said inner and outer cases, 1 and 2, through a hinge 4, so as to be able to open or close freely. The door is provided with a peep hole 5 through which a reinforced glass is inserted, together with being composed of double walls, inner and outer walls.

A large water tank 6 is mounted on the inner and outer cases, 1 and 2. A plurality of small holes 7 are perforated through the upper brim of said water tank 6. Further, around the outside of said outer case there is provided a water pool case 8, and, from the upper part thereof, excess water gathered therein may flow down. Furthermore, a plurality of vertical dashboards 9 are attached to the inside of said water pool case. The numeral 10 is an outer wall-plate capable of covering the outer circumferences of said water pool case 8 and said water tank 6. At the inner side of said outer wall-plate 10 fiber plates 11 made of glass wool or the like are laminated on one another. Among said outer wall-plate 10, the water tank 6 and the water pool case 8, a space capable of falling down waters therefrom is provided. The numeral 12 is a plurality of water outlets perforated at the upper part in said water pool case 8, under which guide plates 13 are attached, whereby discharged waters from said water outlets 12 are splashed in all directions.

On the outer surface of said door 3, such water pool case and an outer wall-plate having fiber plates 11 are also attached respectively. In FIG. 1, the numeral 14 is a supply pipe which is able of supplying water to the water tank 6, door 3 and water pool case 8 respectively and a valve 15 is attached thereto. Further, the numeral 16 is also a water supply pipe having a valve 17 and is banded together halfway with an air supply pipe 18. Furthermore, the numeral 19 is an exhaust pipe, and the numeral 20 is an air tank having a valve 21 on the top end thereof. The numeral 22 is a packing.

The jacket according to this invention has such a structure described above. Accordingly, at the fire, when the valves 15 and 17 attached to the water supply pipes 14 and 16 respectively are opened after entering the room and closing the door 3, the waters are supplied to the water pool case 8 and the water tank 6 respectively. When the waters reach to the upper parts of said pool case and water tank, the waters spout out from water outlets 12 and small holes 7 respectively towards the outside, and then flow down along the fiber plates 11 always wetting them after striking against said fiber plates 11 laminated on the inner surface of the outer wall-plate 10. At the same time, the supply of air or oxygen is also possible by opening the valve 21 in air tank 20.

The jacket according to this invention is structured with a double case system. Further, said jacket has the water pool case at the outside and the large water tank on the upper part. Furthermore, the waters which flow down from said water pool case and the water tank are possible to cool the fiber plates inside the outer wall-plate provided with the outside of said water pool case and water tank by always wetting said fiber plates, whereby the fire can be entirely intercepted.

I claim:

1. A water cooling jacket for fire comprising:

inner and outer side cases installed with a given interval therebetween;

a water tank mounted on a ceiling of said side cases;

means for forming a water pool case capable of gathering waters outside the outer side case;

an outer wall-plate covered on the inside thereof with fiber plates such as glass wools or the like spaced with an interval from the outside of the outer case; and means for making waters flowing from said water tank and said water pool case fall down along the outer wall-plate continuously.

2. A water cooling jacket for fire according to claim 1, wherein said means for making comprises a plurality of small holes perforated through the upper brim of said water tank, whereby water can be splashed therefrom.

3. A water cooling jacket for fire according to claim 1 or 2, wherein said means for making comprises a plurality of water outlets perforated through the upper part of said water pool case.

4. A water cooling jacket for fire according to claim 1 or 2, which comprises a plurality of vertical guide plates inside the water pool case.

5. A water cooling jacket for fire according to claim 1 or 2, which comprises a door providing access to the interior of said inner side case and having a water pool case and an outer wall-plate.

6. A water cooling jacket for fire according to claim 2, wherein said means for making further comprises a plurality of water outlets perforated through the upper part of said water pool case, and wherein said jacekt further comprises a plurality of vertical guide plates inside the water pool case, and a door providing access to the interior of said inner side case and having a water pool case and an outer wall-plate.

* * * * *